United States Patent [19]

Jackson

[11] 4,165,994

[45] Aug. 28, 1979

[54] MACHINE FOR WASHING AND DRYING PARTS

[76] Inventor: Warren M. Jackson, 5071 Crofton, Rockford, Ill. 61101

[21] Appl. No.: 866,275

[22] Filed: Jan. 3, 1978

[51] Int. Cl.[2] ..... B08B 3/02; B08B 3/10

[52] U.S. Cl. ..... 134/104; 134/25 R; 134/118; 134/134; 134/141; 134/153; 134/160; 51/164 R

[58] Field of Search ..... 51/164; 134/104, 116–121, 134/140–141, 149, 153, 157–160, 183, 25 R, 133–134; 118/19, 418

[56] References Cited

U.S. PATENT DOCUMENTS

| | | | |
|---|---|---|---|
| 1,706,877 | 3/1929 | Fabens | 51/164 X |
| 2,290,036 | 7/1942 | Davis | 134/134 X |
| 2,763,564 | 9/1956 | McKenzie et al. | 134/153 X |
| 3,103,225 | 9/1963 | Schmitt-Matzen | 134/183 X |

FOREIGN PATENT DOCUMENTS

| | | | |
|---|---|---|---|
| 1477965 | 6/1969 | Fed. Rep. of Germany | 134/153 |
| 652787 | 2/1963 | Italy | 118/19 |
| 6516933 | 12/1965 | Netherlands | 134/153 |
| 615904 | 1/1949 | United Kingdom | 134/117 |
| 808521 | 2/1959 | United Kingdom | 51/164 |

*Primary Examiner*—Robert L. Bleutge
*Attorney, Agent, or Firm*—Leydig, Voit, Osann, Mayer & Holt, Ltd.

[57] ABSTRACT

Screw blanks are loaded automatically into a rotatable tub while the latter is in an inclined loading-washing position. As the tub rotates, a washing liquid is sprayed into the tub to clean residue from the blanks and to wash chips from the blanks, the liquid and the chips escaping through a gap of adjustable width at the bottom of the tub. The tub then is swung to a vertical position and is rotated at a much faster speed to dry the blanks. Thereafter, the tub is tilted to an unloading position and the blanks are automatically dumped from the tub.

9 Claims, 9 Drawing Figures

MACHINE FOR WASHING AND DRYING PARTS

BACKGROUND OF THE INVENTION

This invention relates to a machine for washing, polishing and drying parts such as screw blanks which have been newly formed by a cold header or the like. Upon being discharged from the header, the screw blanks contain a coacting of greasy residue and are mixed with chips of various sizes and shapes. It is necessary to remove the residue and to separate the chips from the blanks before the blanks are subjected to other screw manufacturing operations such as slotting and threading.

With one prior arrangement, the screw blanks are carried in a basket adapted to be traversed above and then plunged upwardly and downwardly in a bath of hot cleaning solution. The basket then is plunged into a rinsing solution and thereafter is moved into a hot air drying area. Another prior arrangement utilizes an auger which conveys the screw blanks through a tube with the blanks first moving past a series of spray nozzles and then moving past hot air blowers. Still another way to wash and dry screw blanks is to wash the blanks in a vessel similar to that of a small cement mixer and then to transfer the blanks to and dry the blanks in a centrifuge.

SUMMARY OF THE INVENTION

The general aim of the present invention is to provide a new and improved machine which may be easily loaded and unloaded, which washes, polishes and drys the parts while the parts are in a single vessel, which effectively separates chips and scrap from the parts and which may be used with several different types and sizes of parts.

A more detailed object is to achieve the foregoing by providing a machine having a rotatable tub adapted to be moved to different inclined positions to facilitate loading and unloading of the parts and to facilitate washing and drying of the parts. Before the tub is loaded, it is flushed and cleaned with a washing solution that escapes through a relatively large gap at the bottom of the tub. The gap then is closed to a size just smaller than the parts and, while the tube is in an inclined position, parts are loaded into the tub. The inclined tub then is rotated at a slow speed while additional washing solution is introduced into the tub. Thus, the parts are tumbled through and washed by the solution with the chips and other foreign matter being flushed through the gap at the bottom of the tub.

After the washing cycle has been completed, the tub is swung to an upright position and is rotated at a much faster speed to sling the washing solution out of the tub through the gap and to spin dry and polish the parts. Thereafter, the tub is swung to yet another position to dump the parts from the tub.

An important object of the invention is to provide means for enabling the dimension of the gap to be easily adjusted in accordance with the size of the parts being handled.

These and other objects and advantages of the invention will become more apparent from the following detailed description when taken in conjunction with the accompanying drawings.

Figure 1:
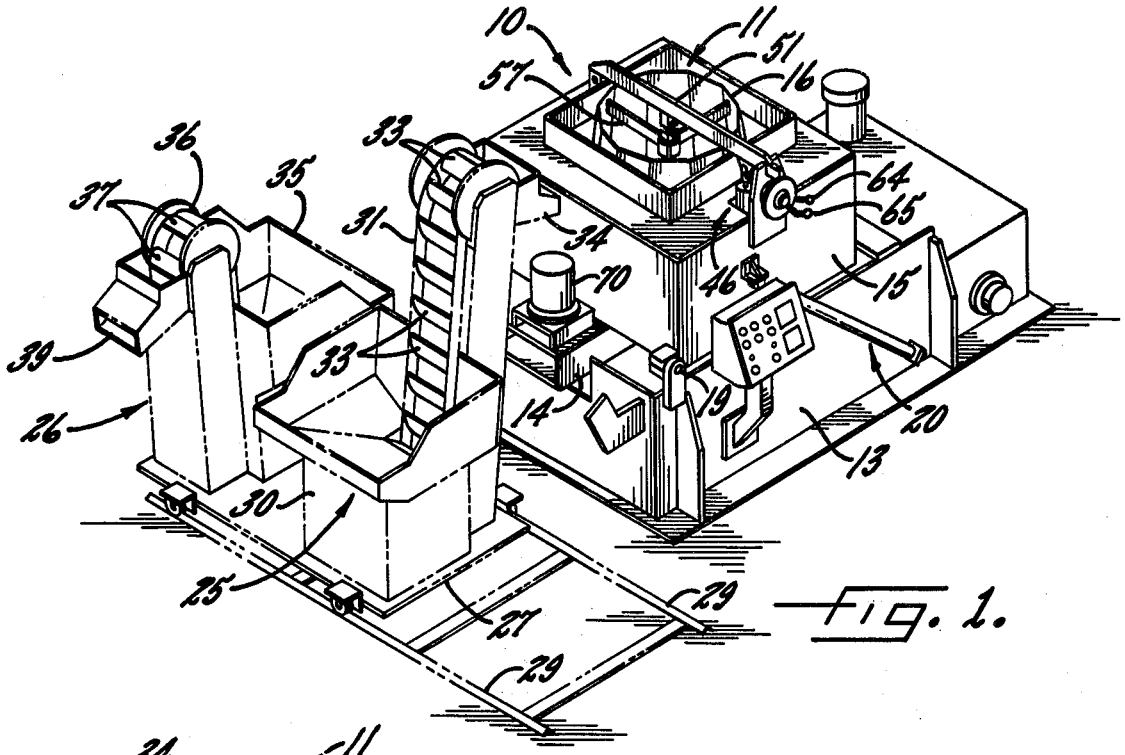
FIG. 1 is a perspective view of a new and improved machine incorporating the unique features of the present invention and shows the machine in conjunction with apparatus for loading parts into and unloading parts from the tub of the machine.

FIG. *2a* is a reduced side elevational view of the machine illustrated in FIG. 1 and shows the tub in its loading-washing position.

FIG. *2b* is a view similar to FIG. *2a* but shows the tub in its drying position.

FIG. *2c* also is a view similar to FIG. *2a* but shows the tub in its unloading position.

Figure 3:
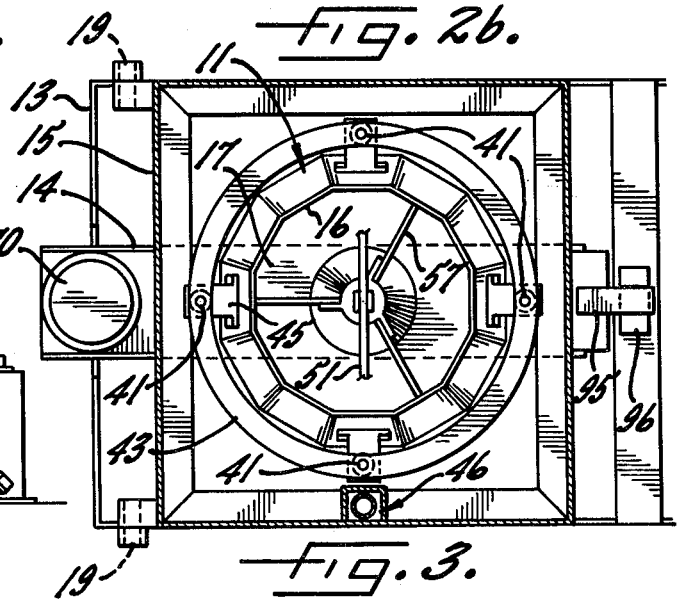

FIG. 3 is an enlarged top plan view of the machine shown in FIG. 1.

Figure 4:
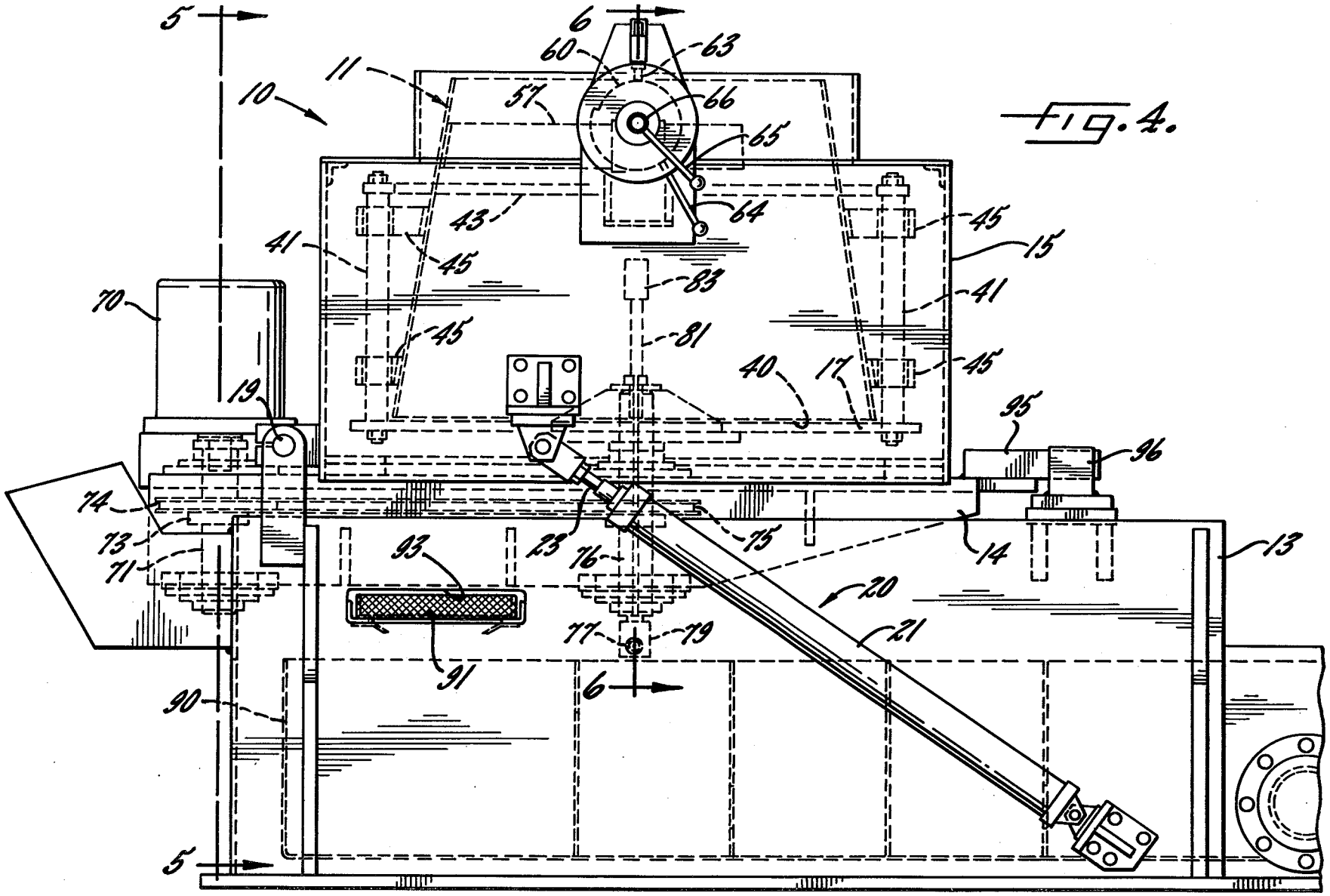

FIG. 4 is a side elevational view similar to FIG. *2b* but on an enlarged scale.

Figure 5:
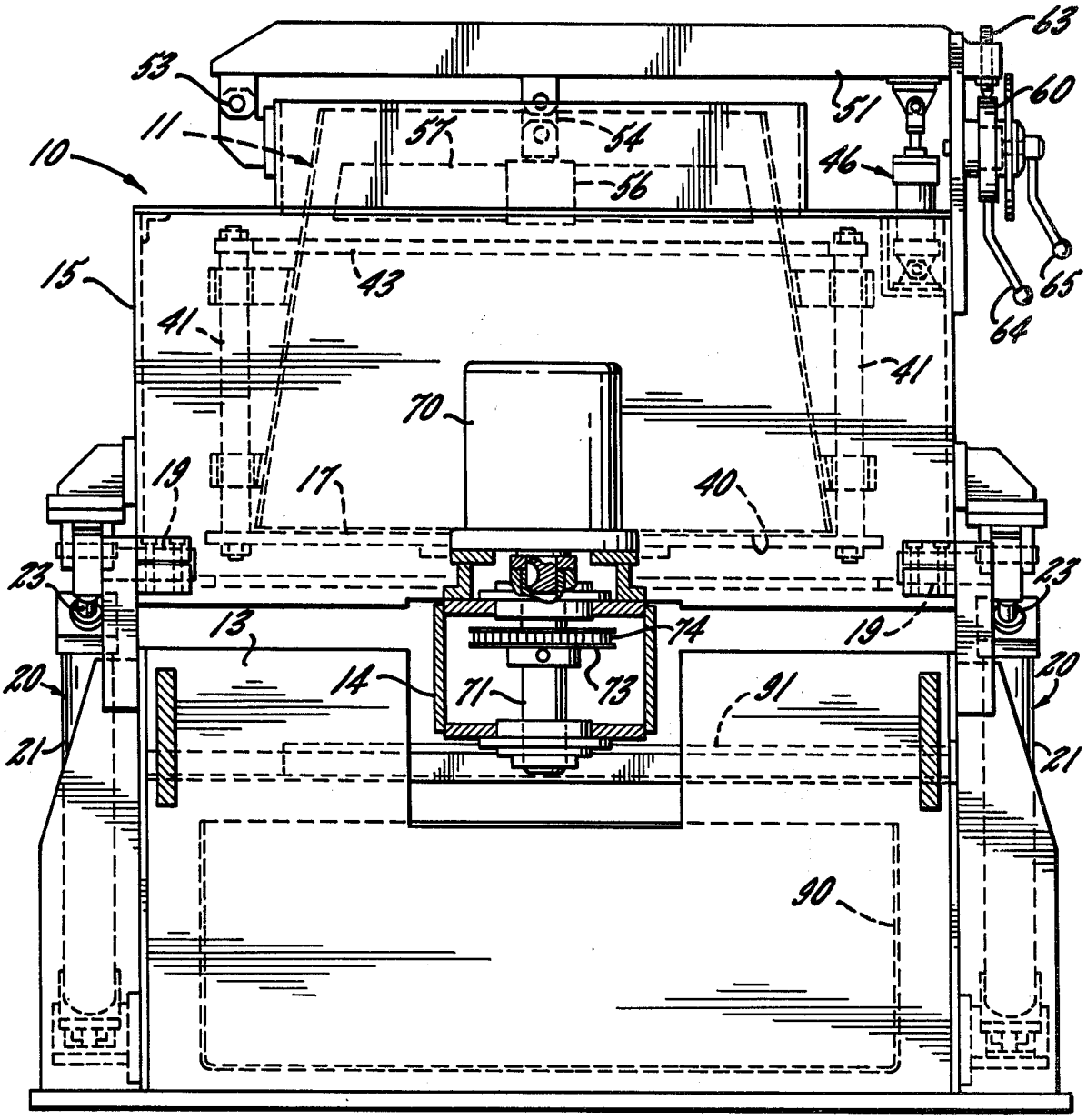
Figure 6:
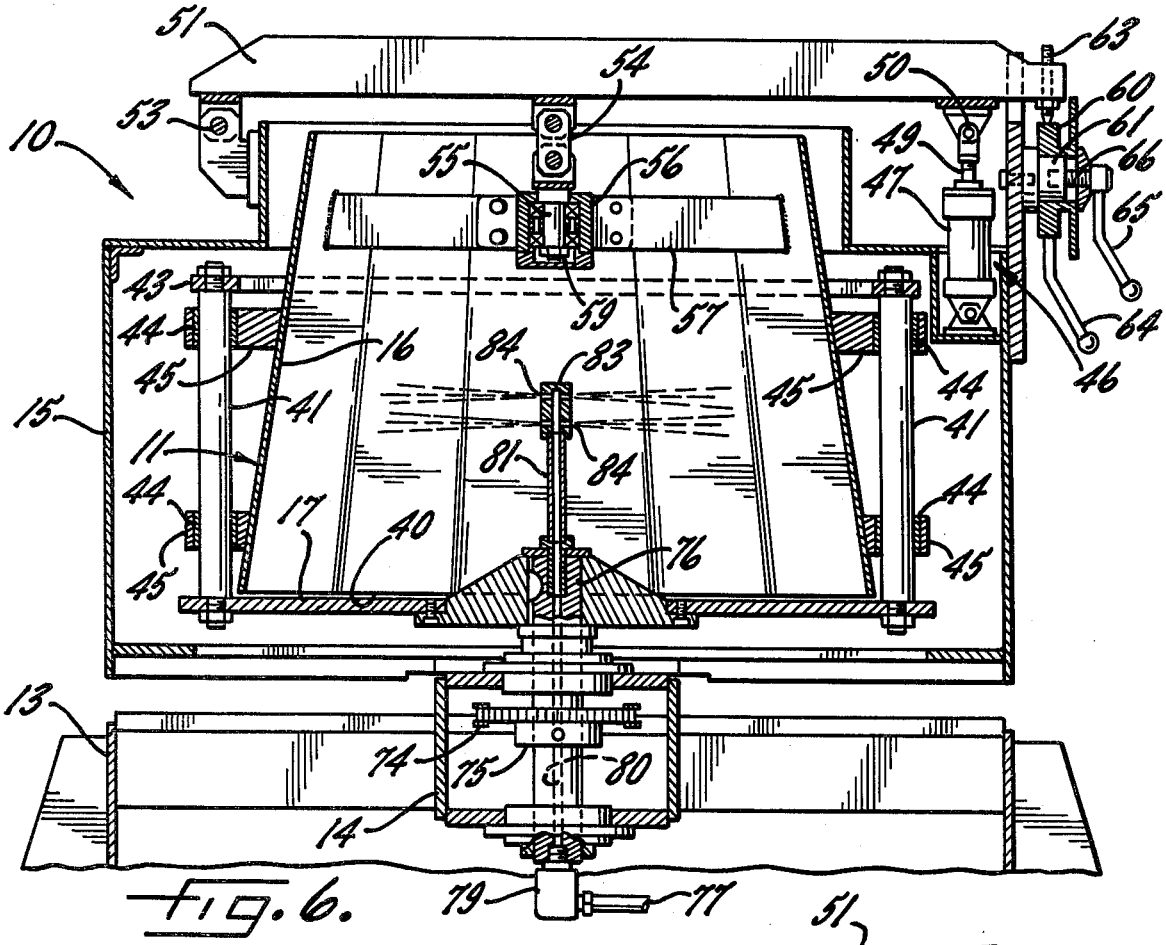

FIGS. 5 and 6 are cross-sections taken substantially along the lines 5—5 and 6—6, respectively, of FIG. 4.

Figure 7:
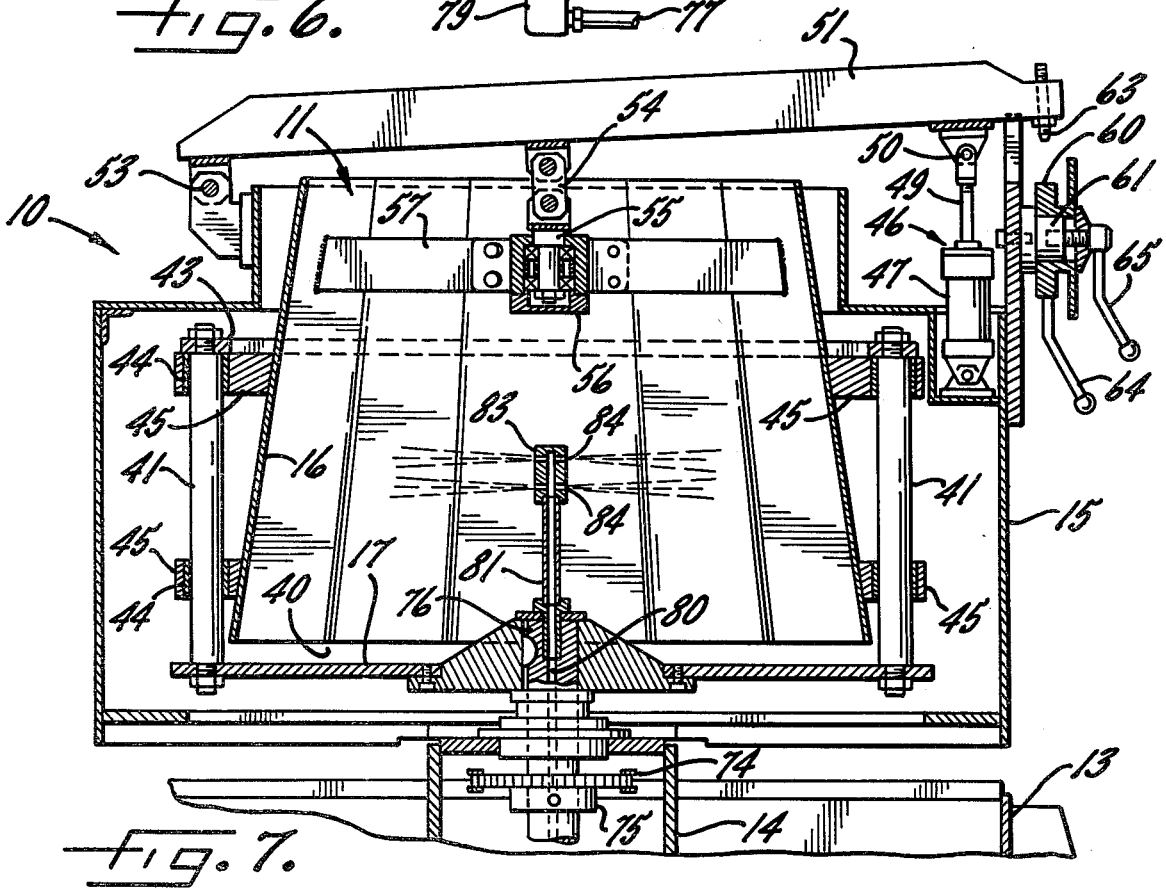

FIG. 7 is a view similar to FIG. 6 but shows certain parts in moved positions.

DETAILED DESCRIPTION OF THE PREFERRED EMBODIMENT

As shown in the drawings for purposes of illustration, the invention is incorporated in a machine 10 for washing, polishing and drying relatively small parts. The present machine is particularly adapted for use with screw blanks which have been newly formed by a cold header. During the heading operation, the screw blanks become coated with a greasy residue and each batch of blanks is mixed with chips, metal particles and other scrap.

The present invention contemplates the provision of a comparatively simple machine 10 which washes the screw blanks, separates foreign material therefrom and then polishes and drys the blanks. The machine is particularly characterized by its ability to effectively handle screw blanks of various sizes and by the fact that the washing, polishing and drying operations all take place in a single vessel 11.

More specifically, the machine 10 includes a main support or base 13 which rests on the floor and which is shaped as a box-like structure having an open top. A support frame 14 is mounted on the base 13 and, in turn, rigidly supports a box-like housing 15. The vessel 11 is disposed in the housing and herein is in the form of a rotatable tub having an open top. The tub is defined by a twelve-sided shell 16 (FIGS. 3 and 6) having open upper and lower ends and by a bottom wall 17 which is adapted to cover the lower end of the shell.

In keeping with the invention, the tub 11 is adapted to be swung between three positions, namely, a loading-washing position (FIG. *2a*), a drying position (FIG. *2b*) and an unloading position (FIG. *2c*). For this purpose, the frame 14 is pivotally mounted on the base 13 at 19 (FIG. 4) to swing about a horizontal axis. Swinging of the frame and the tub 11 is effected by a pair of hydraulic actuators 20 (FIGS. 4 and 5) located on opposite sides of the base and each having a cylinder 21 connected pivotally to the base. A rod 23 is telescoped into each cylinder and is connected pivotally to the housing 15.

When the rods 23 are retracted, the tub 11 is held in its drying position (FIG. *2b*) and is disposed with its axis located in a vertical position. When the rods are partially extended, the tub is swung upwardly to its loading-washing position (FIG. 2*a*) and, in this position, the axis of the tub is inclined at an acute angle (e.g., 55 degrees) relative to the vertical. Upon full extension of the rods, the tub is swung to its unloading position (FIG. 2*c*) and is located such that is axis is inclined at an obtuse angle relative to the vertical, the obtuse angle herein being approximately 120 degrees.

Loading of the screw blanks into and unloading of the blanks from the tub 11 are effected by loading and unloading units 25 and 26 (FIG. 1), respectively. The two units are mounted on a wheeled carriage 27 which is adapted to be moved back and forth along tracks 29 to locate first the loading unit 25 and then the unloading unit 26 in an active position alongside the tub.

The loading unit 25 comprises a hopper 30 adapted to hold a relatively large quantity of screw blanks and further comprises a generally vertical endless conveyor 31 extending a substantial distance upwardly from the hopper. During the loading portion of a cycle when the loading unit 25 is in its active position, several buckets 33 which are carried by and spaced along the conveyor scoop up screw blanks in the hopper, advance the blanks upwardly and then dump the blanks into a downwardly inclined chute 34 at the upper end of the conveyor. The chute extends a short distance into the tub 11 when the latter is in its loading-washing position and thus the blanks spill from the chute and into the tub. Typically, between 500 and 800 pounds of blanks are delivered into the tub during the loading portion of a cycle.

Figure 2A:
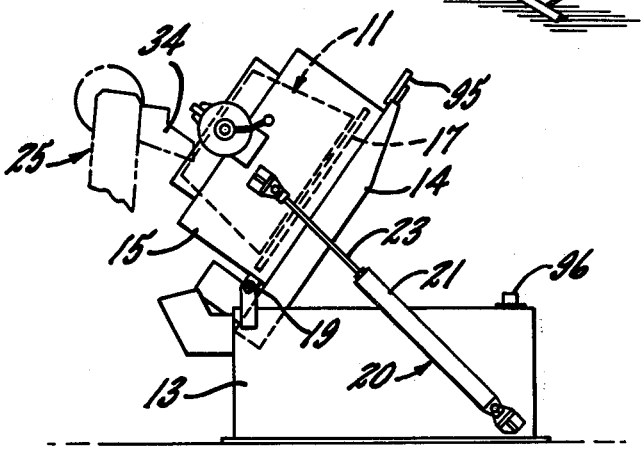
Figure 2B:
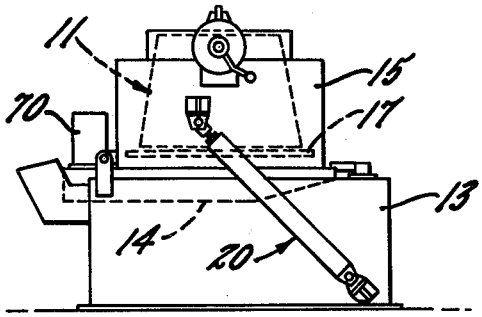
Figure 2C:
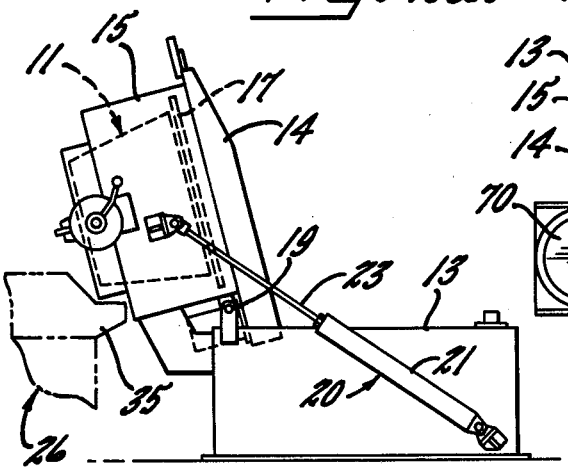

After the blanks have been dried, the unloading unit 26 is moved to its active position alongside the tub 11 and then the tub is swung to its unloading position (FIG. 2*c*). As a result, the blanks spill out of the tub and into a hopper 35 which forms part of the unloading unit. An endless conveyor 36 having buckets 37 leads out of the hopper 35 and is adapted to carry the blanks from the hopper to a discharge chute 39. A wheeled cart (not shown) may be positioned below the chute 39 to receive the blanks which are discharged from the chute.

An important feature of the invention resides in the fact that the shell 16 and bottom wall 17 of the tub 11 are relatively movable so that an opening or gap 40 (FIGS. 6 and 7) of selectively adjustable width may be established between the shell and the bottom wall. Shortly after the start of a cycle, the gap is set so as to have a width just slightly less than the size of the screw blanks which are to be handled during a cycle. During the washing portion of the cycle, a washing liquid is introduced into the tub to wash the blanks and such liquid escapes through the gap. Chips, particles and other scrap are flushed through the gap by the liquid and thus the foreign material is separated from the blanks. During the drying portion of the cycle, the washing liquid is slung through the gap along with any remaining particles which are of such size as to be capable of passing through the gap. After one batch of blanks has been unloaded from the tub and before loading of another batch, the gap 40 is widened and the tub is flushed with washing liquid so as to clean residue from the tub.

In the present instance, the gap 40 is adjusted by moving the shell 16 of the tub 11 although such adjustment could be effected by moving the bottom wall 17. As shown in FIGS. 3 and 6, four guide rods 41 are anchored to and project upwardly from the bottom wall 17 and are connected at their upper ends to a ring 43 which loosely surrounds the shell 16. Slidably received on each rod 41 is a set of upper and lower bushings 44 (FIG. 6) which are secured within upper and lower ears 45 connected to and projecting radially outwardly from the shell. By virtue of the rods 41 and the bushings 44, the shell 16 and the bottom wall 17 of the tub 11 are connected together for rotation in unison and yet the shell can be moved upwardly and downwardly relative to the bottom wall to change the width of the gap 40.

Upward and downward movement of the shell 16 is effected by a hydraulic actuator 46 (FIG. 6) having a cylinder 47 pivotally connected to the housing 15 and having a rod 49 slidably received in the cylinder. The upper end of the rod is connected pivotally at 50 to one end of a lever 51 whose other end is connected pivotally at 53 to the housing 15, the lever extending generally horizontally across the upper end of the shell 16. At approximately its midpoint, the lever is connected by a pivoted clevis 54 to a pin 55 which extends into a bearing assembly 56. The latter is rotatable on the pin and is secured to a spider 57 which is connected to the inner side of the shell. A nut 59 on the pin holds the pin and the bearing assembly against axial separation. Thus, the shell 16 is rotatable on the pin 55 but may be raised and lowered on the rods 41 when the rod 49 of the actuator 46 is extended and retracted to swing the lever 51 upwardly and downwardly. In the fully raised position of the shell, the width of the gap 40 is approximately ½ inch.

When the shell 16 is moved downwardly, it may be stopped in various selected positions established by the operator of the machine 10 so that the operator may set the gap 40 at a width which is appropriate for the size of screw blanks being handled. For this purpose, an abutment in the form of an eccentric cam 60 (FIGS. 4 and 6) is rotatably mounted on a hub 61 on the housing 15 and underlies a stop screw 63 which is secured to the lever 51 adjacent the pivot 50. When the rod 49 of the actuator 46 is retracted, the shell 16 moves downwardly until the screw 63 engages and stops against the periphery of the cam 60. By rotating the cam with a handle 64 attached thereto, the cam may be positioned to stop the shell at various elevations. Once the cam has been adjusted, it may be locked in its adjusted position by turning a handle 65 (FIG. 6) to tighten a screw 66 which is threaded into the hub 61 and to thereby clamp the cam between the hub and a relatively large washer on the screw.

The tub 11 is adapted to be rotated by a variable speed rotary hydraulic motor 70 (FIG. 5) supported on the pivoted frame 14 and having a downwardly projecting drive shaft 71 which carries a sprocket 73. A chain 74 is trained around the sprocket 73 and around another sprocket 75 (FIG. 6) which is secured to a shaft 76. The latter is rotatably journaled by the frame 14 and is keyed to the bottom wall 17 of the tub 11. Thus, the shaft 76 rotates the bottom wall 17 which, in turn, rotates the shell 16 by virtue of the guide rods 41.

Liquid is adapted to be introduced into the tub 11 by way of a line 77 (FIG. 6) communicating at one of its ends with a pump (not shown) and at its other end with a rotary union 79. The latter is connected to the lower end of the shaft 76 and communicates with a passage 80 extending upwardly through the shaft. A tube 81 is secured to the upper end of the shaft 76 and carries a spray nozzle 83 which communicates with the passage 80 by way of the tube, there being several radially opening passages 84 formed in the nozzle. When the tub is rotated, the nozzle rotates with the shaft 76 and causes pressurized jets of liquid to be sprayed into the tub through the passages 84.

To gain an understanding of the operation of the machine 10, let it be assumed that one batch of screw blanks has just been dumped from the tub 11 and that the tub has been swung from its unloading position (FIG. 2*c*) to its loading-washing position (FIG. 2*a*). When in the latter position, the tub is rotated slowly at a rate of about 10 R.P.M.

To initiate a cycle, the operator of the machine 10 actuates a control to cause the rod 49 of the actuator 46 to extend and raise the shell 16 of the tub 11 to its fully open position (see FIG. 7) with respect to the bottom plate 17. With the gap 40 thus adjusted to its maximum width, the pump is started and introduces a heated washing liquid into the rotating tub through the nozzle 83. The washing liquid may, for example, be a solution of a water soluble composition identified by the trademark TRIM, the solution containing a rust inhibitor and being capable of maintaining its characteristics even if reheated many times.

The liquid introduced into the tub 11 flushes the latter of any remaining chips and screw blanks and washes residue from the shell 16 and the bottom plate 17. The liquid and particles drain from the tub through the gap 40 and flow toward a tank 90 (FIG. 4) which is housed within the base 13. During such flow, the particles are strained by and collected in a mesh basket 91 which overlies the tank and which is supported removably within an opening 93 in the base.

While the flushing operation is taking place, the operator of the machine 10 adjusts the cam 60 in order to establish the width of the gap 40 in accordance with the size of the screw blanks of the next batch to be washed. The gap should be sufficiently narrow to restrict the passage of the screw blanks from the bottom of the tub 11 but should be as wide as possible so that chips which are just slightly smaller than the blanks may escape through the gap.

After completion of the flushing portion of the cycle, the operator of the machine 10 actuates a control to retract the rod 49 of the actuator 46. The shell 16 thus moves downwardly until the screw 63 engages the cam 60 and stops the shell in its restricting position (FIG. 6) with the gap 40 at the pre-established width. Shortly thereafter, the conveyor 31 of the loading unit 25 automatically starts and loads screw blanks into the tub 11 to initiate the washing portion of the cycle. The conveyor 31 is shut off after a desired quantity of screws has been loaded into the tub.

During the washing portion of the cycle, the tub 11 is rotated slowly (i.e., about 10 R.P.M.) while in its inclined loading-washing position (FIG. 2*a*). As the tub rotates, the washing solution is sprayed into the tub through the nozzle 83 and flows past and intimately scrubs the screw blanks as the latter tumble within the tub and through the bath of solution. The tumbling action of the blanks causes the parts to rub against one another and the sides of the shell to polish the parts and to help remove residue from the parts. The residue, the liquid and the chips and other particles flow through the gap 40 with the liquid thence flowing into the tank 90 and with the solids being caught in the basket 91.

The washing portion of the cycle lasts for about five minutes and then the tub 11 is swung downwardly to its drying position (FIG. 2*b*) and the flow of liquid into the tub is shut off. As the tub reaches its drying position, a bar 95 (FIG. 4) which projects outwardly from the frame 14 moves between the legs of a U-shaped stirrup 96 on the base 13. The purpose of the bar and the stirrup is to lock the frame 14, the housing 15 and the tub 11 in a stable position when the tub is rotated at high speed during the drying portion of the cycle.

After the tub 11 has reached its drying position, the speed of the motor 70 is increased to rotate the tub at a much faster speed such as 200 R.P.M. The tub thus acts as a centrifuge to spin dry the screw blanks. Accordingly, the liquid remaining in the tub and the droplets of liquid on the blanks are slung through the gap 40.

The drying portion of the cycle is sufficiently long to leave the screw blanks relatively dry. Thereafter, the tub 11 is slowed to approximately 10 R.P.M. and is swung to its unloading position (FIG. 2*c*). As the tub turns, the screw blanks spill into the hopper 35 of the loading unit 26 and are picked up by the buckets 37 of the conveyor 36. The tub then is swung to its loading-washing position (FIG. 2*a*) preparatory to the start of the next cycle.

From the foregoing, it will be apparent that the present invention brings to the art a new and improved machine 10 capable of washing, polishing and drying parts within a single tub 11 which may be automatically loaded and unloaded and which may be easily adjusted to handle parts of different sizes. While the machine has been disclosed specifically for use with screw blanks, it will be apparent that many other types of items may be washed and dried by the machine.

I claim:

1. A machine for washing parts, said machine comprising a support, a tub mounted on said support and having a top and a bottom, mechanism for rotating said tub about a vertically and horizontally inclined axis, an axially and circumferentially extending opening at the bottom of said tub, and means for enabling the axial dimension of the opening to be selectively adjusted in accordance with the size of the parts.

2. A machine for washing parts, said machine comprising a support, a tub mounted on said support, mechanism for rotating said tub about a vertically inclined axis, said tub comprising a shell having open upper and lower ends and further comprising a bottom wall for covering the lower end of said shell, an opening at the bottom of said tub and defined by an axial gap between said bottom wall and the lower end of said shell, and means mounting said shell for axial movement relative to said bottom wall to enable the axial dimension of said gap to be selectively adjusted in accordance with the size of the parts.

3. A machine as defined in claim 2 in which said mechanism includes a rotary shaft coupled to said bottom wall, said means comprising guide rods coupling said bottom wall and said shell for rotation in unison while mounting said shell for up and down axial movement relative to said bottom wall, a power actuator coupled to said shell and operable to move said shell upwardly and downwardly relative to said bottom wall, and an abutment for limiting downward movement of said shell and selectively adjustable to stop said shell in various selected positions when said shell is moved downwardly.

4. A machine as defined in claim 3 in which said actuator includes a vertically reciprocable rod, a generally horizontal lever having one end portion pivotally connected to said rod and having an opposite end portion pivotally connected to said support, and means connecting an intermediate portion of said lever to said shell and permitting said shell to rotate relative to said lever.

5. A machine for washing parts, said machine having a support, a tub comprising a shell having open upper and lower ends and further comprising a bottom wall for covering the lower end of said shell, mechanism on said support and having a drive shaft connected to rotate said bottom wall, means coupling said bottom wall and said shell for rotation in unison while mounting said shell for up and down axial movement relative to said bottom wall, a power operated actuator, means connecting said actuator to said shell to enable said actuator to move said shell upwardly and downwardly relative to said bottom wall while permitting said shell to rotate relative to said actuator, and an abutment mounted on said support and selectively adjustable to stop said shell in various selected positions relative to said bottom wall when said shell is moved downwardly.

6. A machine as defined in claim 5 in which said abutment comprises a cam, and means mounting said cam on said support for rotation to different selected positions.

7. A machine as defined in claim 6 in which said actuator includes a vertically reciprocable rod, said connecting means comprising a lever having one end portion pivotally connected to said rod, having an opposite end portion pivotally connected to said support and having an intermediate portion connected to said shell, and means on said one end portion of said lever and engageable with said cam to stop downward movement of said shell when said rod is shifted downwardly.

8. A machine for washing parts, said machine comprising a support, a tub mounted on said support for rotation about its own axis, means mounting said tub for swinging between a washing position and a drying position, the axis of said tub being substantially vertical when the tub is in its drying position and being inclined relative to the vertical when the tub is in its washing position, there being an axially and circumferentially extending opening at the bottom of the tub with the axial dimension of the opening being of insufficient size to permit parts to pass therethrough, means for introducing a washing liquid into said tub when the latter is in its washing position and while parts are in the tub, mechanism for rotating said tub at a selected speed while the tub is in its washing position whereby the parts are tumbled and washed, means for thereafter swinging said tub to said drying position, and said mechanism being operable to rotate said tub at a faster speed when the tub is in its drying position thereby to spin said liquid through said opening and to effect drying of the parts.

9. A machine for washing parts, said machine comprising a support, a tub mounted on said support for rotation about its own axis, means for swinging said tub from a washing position to a drying position and then to an unloading position, the axis of said tub being substantially vertical when the tub is in its drying position, being inclined at an acute angle relative to the vertical when the tub is in its washing position and being inclined at an obtuse angle relative to the vertical when the tub is in its unloading position, said tub comprising a shell having open upper and lower ends and further comprising a bottom wall for covering the lower end of the shell, means for moving said shell between a restricting position and an open position, the lower end of said shell being spaced upwardly from said bottom wall by a predetermined distance just less than the size of said parts when the shell is in said restricting position and being spaced upwardly from the bottom wall by a greater distance when the shell is in said open position, means for adjusting the spacing which exists between the lower end of said shell and said bottom wall when the shell is in its restricting position, means for introducing a washing liquid into said tub while the latter is in its washing position and is being rotated and while said shell is in said open position thereby to flush the tub, means for loading parts into said tub while the latter is in said washing position and while said shell is in said restricting position, mechanism for rotating said tub at a first speed while said washing liquid is being introduced into said tub and while said shell is in said restricting position whereby the parts in the tub are tumbled and washed and whereby said washing liquid is discharged between said shell and said bottom wall, said mechanism rotating said tub at a faster speed when said tub is in said drying position and while said shell is in said restricting position whereby said parts are dried, said tub thereafter being moved to said unloading position to dump the parts from the tub.

* * * * *